US011511542B2

(12) United States Patent
Stöckle et al.

(10) Patent No.: US 11,511,542 B2
(45) Date of Patent: Nov. 29, 2022

(54) METHOD AND DEVICE FOR CHECKING A CLEANING UNIT

(71) Applicant: Canon Production Printing Holding B.V., Venlo (NL)

(72) Inventors: Ulrich Stöckle, Munich (DE); Christoph Rummelsberger, Ismaning (DE); Florian Hitzlsperger, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 17/393,644

(22) Filed: Aug. 4, 2021

(65) Prior Publication Data

US 2022/0040981 A1 Feb. 10, 2022

(30) Foreign Application Priority Data

Aug. 4, 2020 (DE) ..... 102020120541.4

(51) Int. Cl.
*B41J 2/165* (2006.01)

(52) U.S. Cl.
CPC ..... *B41J 2/16517* (2013.01); *B41J 2/16552* (2013.01)

(58) Field of Classification Search
CPC ..... B41J 2/16517; B41J 2/16552; B41J 2/16585; B41J 2002/16558
See application file for complete search history.

(56) References Cited

U.S. PATENT DOCUMENTS 5,706,840 A * 1/1998 Schneider ..... B08B 3/00 134/113
6,454,386 B1 * 9/2002 Premnath ..... B41J 2/16552 347/28
2007/0146459 A1 6/2007 Gault et al.
2008/0259114 A1 * 10/2008 Tyvoll ..... B41J 29/17 347/22

FOREIGN PATENT DOCUMENTS

CN 101820807 A * 9/2010 ..... A47L 11/4002
DE 0389481 B1 * 3/1994 ..... B41J 2/16579
JP 2011178068 A 9/2011
JP 2012176545 A 9/2012

OTHER PUBLICATIONS

German Office Action for Application No. 10 2020 120 541.4, dated Jan. 21, 2021.

* cited by examiner

*Primary Examiner* — Sharon Polk
(74) *Attorney, Agent, or Firm* — The Webb Law Firm

(57) ABSTRACT

A device may be configured to check, via evaluation of resistance data of a cleaning sensor arranged on a print bar of an inkjet printing device, whether a cleaner for cleaning the one or more print heads of the print bar exhibits a negative effect. The state of a cleaner may be reliably and efficiently monitored via the installation of a cleaning sensor in a print bar.

15 Claims, 4 Drawing Sheets

METHOD AND DEVICE FOR CHECKING A CLEANING UNIT

CROSS REFERENCE TO RELATED APPLICATIONS

This patent application claims priority to German Patent Application No. 10 2020 120 541.4, filed Aug. 4, 2020, which is incorporated herein by reference in its entirety.

BACKGROUND

Field

The disclosure relates to a method and a corresponding device for checking a cleaning unit (cleaner) for cleaning of the one or more print heads of a print bar of an inkjet printing device.

Related Art

An inkjet printing device for printing to a recording medium may comprise at least one print bar having one or more print heads, wherein each print head typically has a plurality of nozzles. The nozzles are respectively configured to eject ink droplets in order to print dots of a print image on the recording medium. To clean the print heads, said print heads may be cleaned by a cleaning unit having a wiper.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
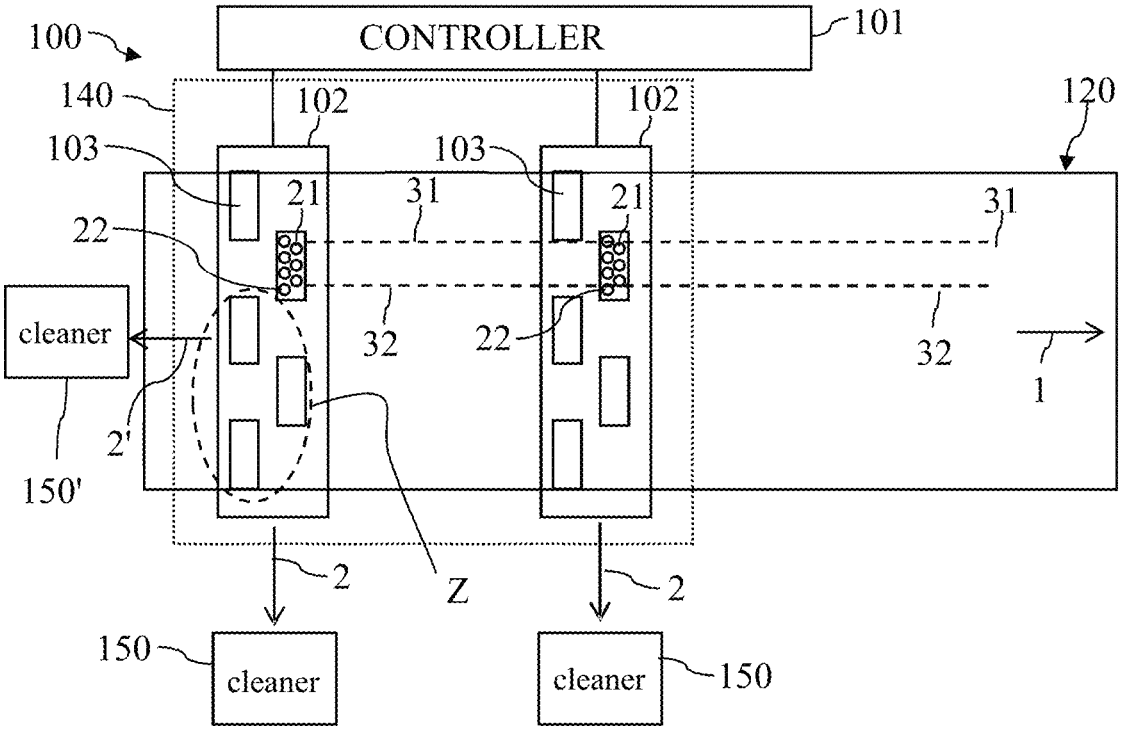

FIG. 1*a* an inkjet printer according to an exemplary embodiment.

Figure 1B:
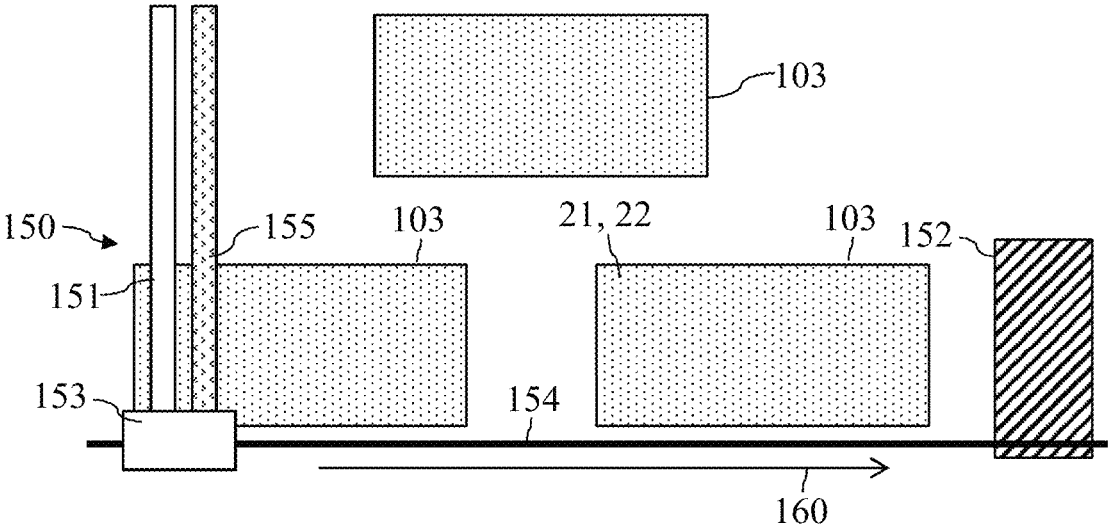

FIG. 1*b* a cleaner of an inkjet printer according to an exemplary embodiment.

Figure 2A:
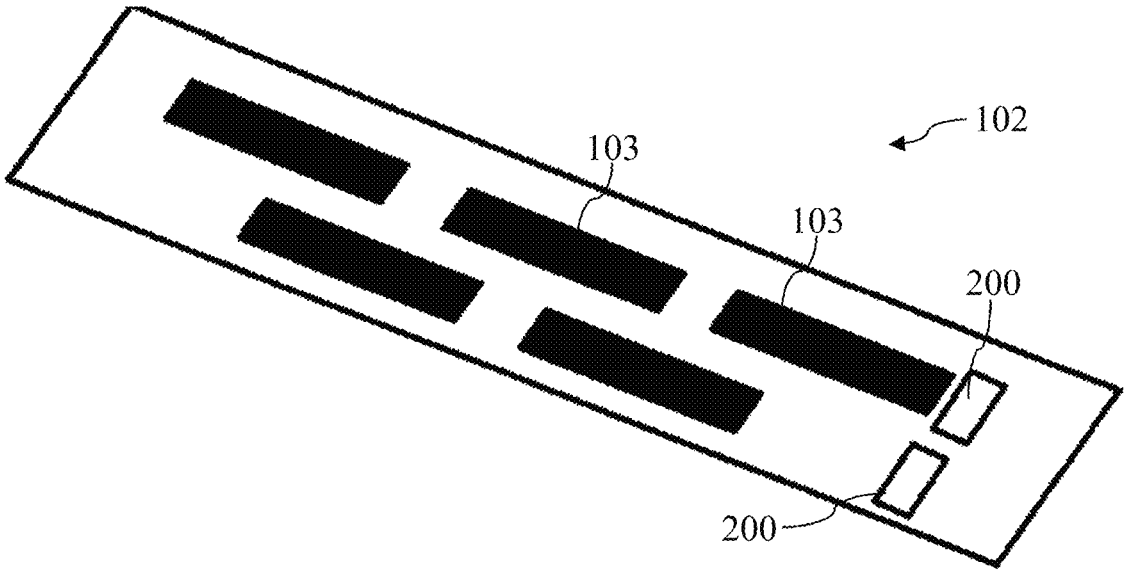

FIG. 2*a* a print bar having a plurality of cleaning sensors, in a view from below, according to an exemplary embodiment.

Figure 2B:
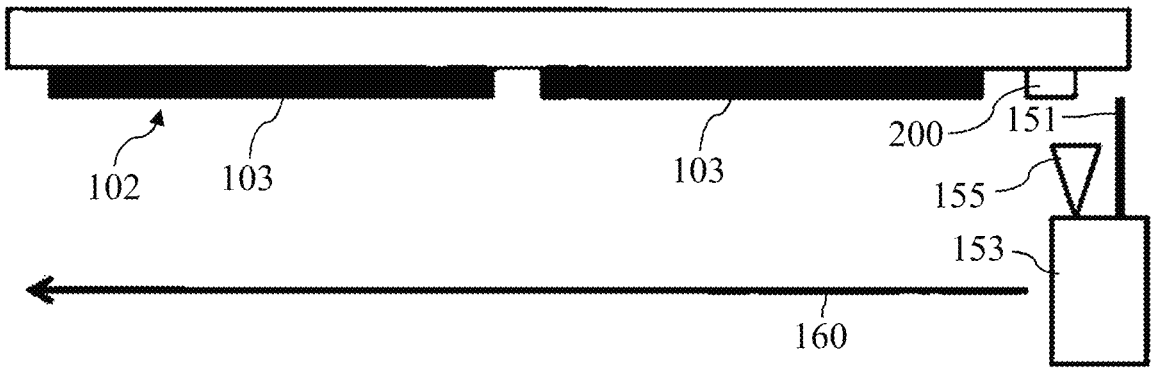

FIG. 2*b* a side view of a print bar having a cleaning sensor according to an exemplary embodiment.

Figure 3A:
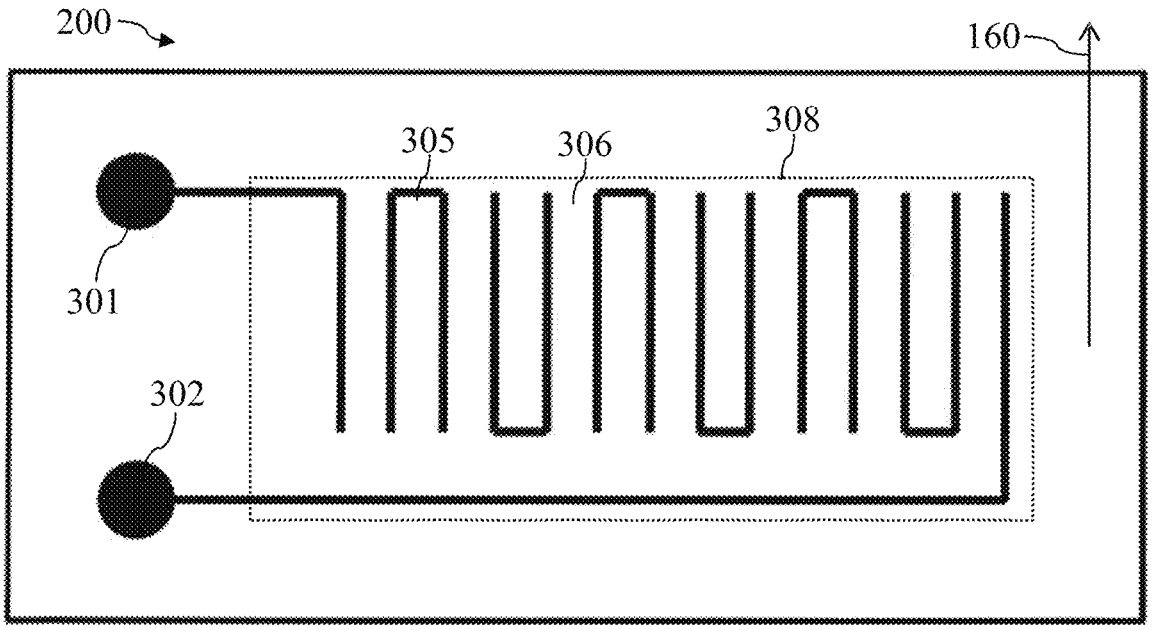

FIG. 3*a* a cleaning sensor according to an exemplary embodiment.

Figure 3B:
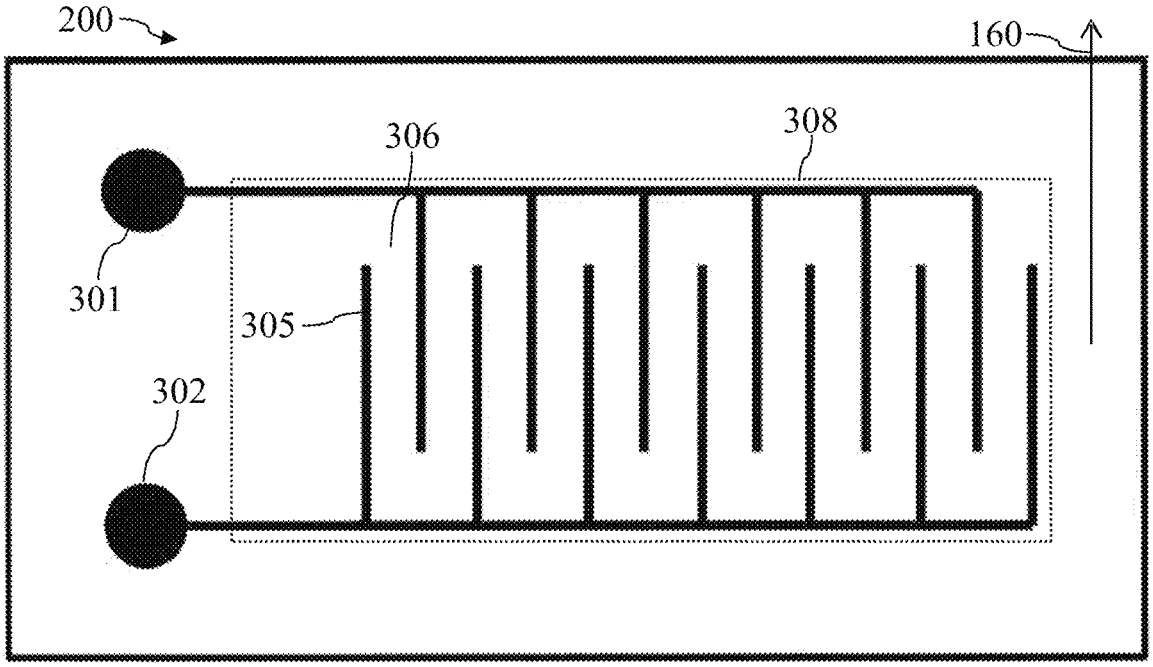

FIG. 3*b* a cleaning sensor according to an exemplary embodiment.

Figure 3C:
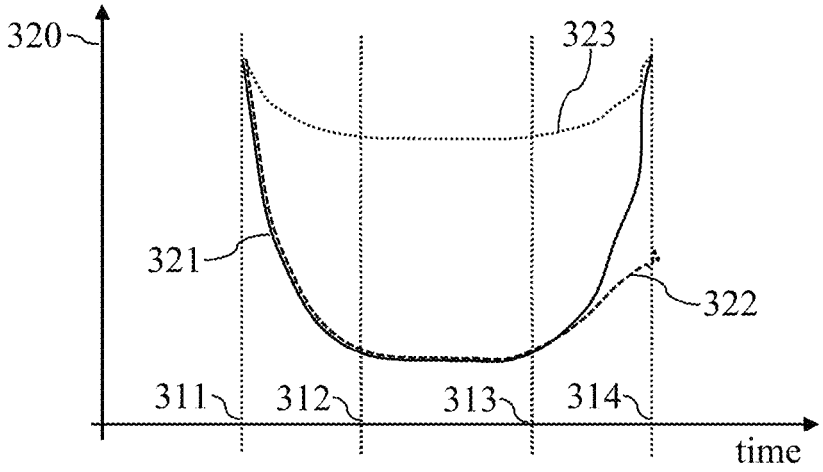

FIG. 3*c* a plot of time curves of the electrical resistance of a cleaning sensor according to an exemplary embodiment.

Figure 4:
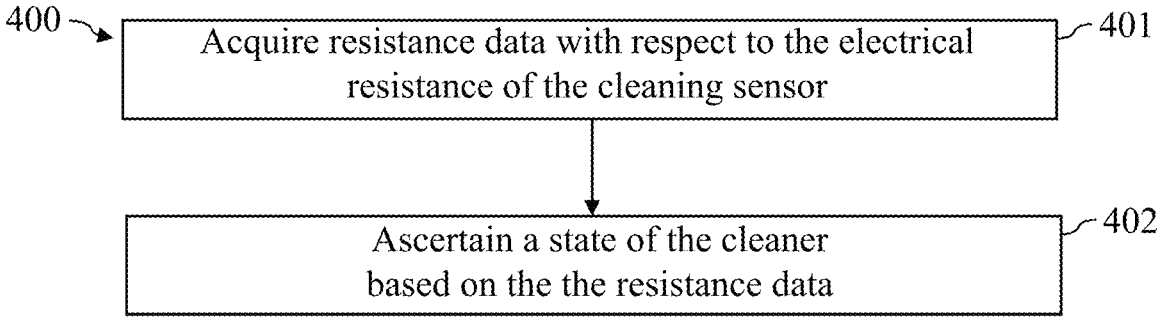

FIG. 4 a flowchart of a method for monitoring a cleaner according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the present disclosure is to enable an efficient and reliable monitoring of the cleaning quality of a cleaning unit (cleaner) in order to effect a continuous high print quality of an inkjet printing device.

According to one aspect of the disclosure, a device is described for checking a cleaner for cleaning the nozzle plates of one or more print heads of a print bar. The print bar comprises a cleaning sensor that exhibits an electrical resistance that depends on whether cleaning fluid is located on the cleaning sensor or not. The cleaner is designed to apply cleaning fluid onto the nozzle plates of the one or more print heads and onto the cleaning sensor, and to subsequently remove said cleaning fluid again, within the scope of a cleaning process. The cleaner may thereby be configured to cover the measurement surface of the cleaning sensor, and if applicable also the nozzle plates, completely with cleaning fluid, and to completely remove the cleaning fluid if the cleaner exhibits no negative effect.

The device is configured to determine, within the scope of a cleaning process of the cleaner, resistance data with respect to the electrical resistance of the cleaning sensor. In particular, the time curve of the electrical resistance during the cleaning process may be determined. Furthermore, the device is configured to detect, on the basis of the resistance data, in particular on the basis of the time curve of the electrical resistance, a negative effect on the cleaner.

According to a further aspect of the disclosure, a method is described for checking a cleaner for cleaning of the nozzle plates of one or more print heads of a print bar. The print bar comprises a cleaning sensor that exhibits an electrical resistance that depends on whether cleaning fluid is located on the cleaning sensor or not. Within the scope of a cleaning process, the cleaner is designed to apply cleaning fluid onto the nozzle plates of the one or more print heads and onto the cleaning sensor, for example via a spray nozzle, and to subsequently remove said cleaning fluid again, for example via a wiper.

The method includes ascertaining, within the scope of a cleaning process of the cleaner, resistance data with respect to the electrical resistance of the cleaning sensor. Furthermore, the method includes determining, on the basis of the resistance data, whether the cleaner exhibits a negative effect or not.

The printing device (printer) 100 depicted in FIG. 1*a* is configured to print to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1, represented by an arrow, through the print group 140 of the printer 100.

In the depicted example, the print group 140 of the printer 100 comprises two print bars 102, wherein each print bar 102 may be used for printing with ink of a defined color, for example black, cyan, magenta, and/or yellow, and if applicable MICR (Magnetic ink character recognition) ink. Furthermore, the printer 100 typically comprises at least one fixer or dryer (not shown) that is configured to fix a print image printed onto the recording medium 120.

A print bar 102 may comprise one or more print heads 103 that, if applicable, are arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of a group of columns 31, 32 of a print image onto the recording medium 120.

In the embodiment depicted in FIG. 1*a*, each print head 103 of the print group 140 comprises a plurality of nozzles 21, 22, wherein each nozzle 21, 22 is configured to fire or eject ink droplets onto the recording medium 120. A print head 103 of the print group 140 may, for example, comprise multiple thousands of effectively utilized nozzles 21, 22 that are arranged along a plurality of rows transverse to the transport direction 1 of the recording medium 120. By means of the nozzles 21, 22 of a print head 103 of the print group 140, dots of a line of a print image may be printed onto the recording medium 120 transverse to the transport direction 1, meaning along the width of the recording medium 120.

In an exemplary embodiment, the printer 100 also includes a controller 101, for example an activation hardware and/or a processor, that is configured to activate the actuators of the individual nozzles 21, 22 of the individual print heads 103 of the print group 140 in order to apply the print image onto the recording medium 120 depending on print data. In an exemplary embodiment, the controller 101 includes processing circuitry that is configured to perform one or more functions and/or operations of the controller 101, including, for example, controlling the activation of the actuators of the individual nozzles 21, 22, controlling the cleaner 150, processing data received from the cleaner 150, processing data received from the cleaning sensor(s) 200, and/or controlling the operation of the printer 100.

The print group 140 of the printer 100 thus comprises at least one print bar 102 having K nozzles 21, 22 that may be activated with a defined line timing in order to print a line, traveling transverse to the transport direction 1 of the recording medium 120, with K pixels or K columns 31, 32 of a print image onto the recording medium 120, in particular with K>1000. In the depicted example, the nozzles 21, 22 are immobile or permanently installed in the printer 100, and the recording medium 120 is directed past the stationary nozzles 21, 22 with a defined transport velocity.

Furthermore, the printer 100 comprises one or more cleaners 150 for the one or more print bars 102. A print bar 102 may be transferred from a printing position, at which the print bar 102 is arranged above the recording medium 120, into a cleaning or service position. For this purpose, the print bar 102 may be moved in the movement direction 2 (transverse to the transport direction 1) or 2' (parallel to the transport direction) indicated by an arrow. In the cleaning or service position, the nozzle plates of the one or more print heads 103 of a print bar 102 may then be cleaned, in particular wiped off, using a cleaner 150. The printer 100 may have a cleaner 150, possibly precisely one cleaner 150, for each print bar 102.

FIG. 1*b* shows an enlarged view of the region Z from FIG. 1*a* from below, toward the nozzle plates of two print heads 103 of a print bar 102 together with a cleaner 150. The print heads 103 are arranged one after another and/or side by side (offset) along a cleaning axis 160. The cleaning axis 160 thereby typically runs parallel to the movement direction 2. The outputs or nozzle openings of the one or more nozzles 21, 22 of the print head 103 are arranged on the underside or at the nozzle plate of a print head 103.

In the cleaning or service position, the one or more nozzles 21, 22 of the print head 103 may be induced to eject ink, for example by increasing the pressure within the one or more nozzles 21, 22. This step is typically referred to as "purging". Furthermore, the nozzle plate of a print head 103 may be sprayed with a cleaning fluid by one or more spray nozzles 155 of the cleaner 150. The underside or nozzle plate of a print head 103 may subsequently be cleaned with a wiper 151 of the cleaner 150. The wiper 151 may be moved across the nozzle plate of a print head 103, along the cleaning axis (cleaning direction) 160, in order to clean the nozzle plate of residual ink and the cleaning fluid. This step is typically referred to as "wiping".

The wiper 151 may be attached to a sled or a wiper holder 153 that is guided along a guide rail 154 to the nozzle plate of a print head 103. The sled 153 may thereby guide one or more wipers 151 across the nozzle plates of a plurality of print heads 103, in particular all print heads 103, of a print bar 102. The fluid that is thereby wiped off, typically composed of ink and cleaning fluid, may drip into a basin (not shown), wherein the basin is arranged below the sled 153. After the nozzle plates of the print heads 103 have been wiped off, the wiper 151 may be moved into a cleaning module 152 in which the wiper 151 is cleaned.

As depicted in FIG. 1*a*, the print heads 103 of a print bar 102 may be arranged in a plurality of rows. The sled 153 may have a wiper 151 that exhibits a sufficiently large width, in the transport direction 1 or transverse to the cleaning axis 160, in order to wipe off the nozzle plates of the print heads 103 in a plurality of rows during a single translation movement along the cleaning axis 160. Alternatively, the sled 153 may have a wiper 151 for each print head row, wherein the wipers 151 are arranged side by side in the transport direction 1.

The one or more print heads 103 of a print bar 102 may be repeatedly cleaned with the cleaner 150 of the print bar 102 in order to produce a consistently high print quality of the printer 100. The cleaning may take place before a start of printing, for example. Within the scope of a cleaning process, it may occur that a component of the cleaner 150 is negatively affected, whereby the cleaning result, and thus the print quality of the printer 100, are in turn negatively affected. For example, a spray nozzle 155 of the printer 100 may be clogged, such that the nozzle plates of the one or more print heads 103 cannot be completely sprayed, or a wiper 151 of the of the printer 100 may possibly be incorrectly set so that the nozzle plates of the one or more print heads 103 are not completely cleaned off. The print quality of the printer 100 may be negatively affected, and/or the wear of the one or more print heads 103 may be accelerated, by an insufficient cleaning.

FIG. 2*a* shows the underside of an example of a print bar 102 having a respective cleaning sensor 200 for each row of print heads 103. A cleaning sensor 200 is configured to capture sensor data with respect to the quality of the cleaning of the nozzle plates of the one or more print heads 103 of the print bar 102. The individual cleaning sensors 200 may thereby be arranged at the print bar 102 such that the one or more cleaning sensors 200 are cleaned as well within the scope of the cleaning of the one or more print heads 103.

FIG. 2*b* shows an example of a print bar 102 in a side view. From FIG. 2*b*, it is to be learned that a cleaning sensor 20 may be arranged before or after a print head 103 along the cleaning axis 160 of the cleaner 150, so that the cleaning sensor 200 is cleaned by the cleaner 150 before or after the print head 103. Cleaning fluid may be sprayed by a spray nozzle 155 onto the surface of the cleaning sensor 200. Furthermore, the cleaning fluid may subsequently be removed again by the wiper 151 from the surface of the cleaning sensor 200.

FIGS. 3*a* and 3*b* show examples of cleaning sensors 200. A cleaning sensor 200 may have two measuring points 301, 302 between which are arranged one or more conductor segments 305 separated by isolating intervening spaces 306. The conductor segments 305 may thereby be distributed across a measurement surface 308 of the cleaning sensor 200.

As depicted in FIG. 3*a*, the conductor segments may be arranged in series with one another so that a series circuit of the individual conductor segments 305 results if the electrical resistance of the non-conductive intervening spaces 306 between the conductor segments 305 situated side by side is reduced. The bridging of the individual intervening spaces 306 may thereby be produced via the cleaning fluid sprayed onto the measurement surface 308 of the cleaning sensor 200. The more cleaning fluid that is present between the intervening spaces 306, the lower the electrical resistance.

In the example depicted in FIG. 3*b*, the individual conductor segments 305 are arranged parallel to one another so that a parallel circuit of the individual conductor segments 305 results if the intervening spaces 306 between the conductor segments 305 situated side by side are bridged so as to be conductive. The bridging of the individual intervening spaces 306 may thereby in turn be produced by the cleaning fluid sprayed onto the measurement surface 308 of the cleaning sensor 200.

In a cleaning process, cleaning fluid is initially sprayed onto the surface 308 of the cleaning sensor 200. As a result of this, the intervening spaces 306 are covered with cleaning fluid so that an electrically conductive connection results between the individual conductor segments 305 of the cleaning sensor 200. As a result of this, the electrical resistance decreases between the measuring points 301, 302 of the cleaning sensor 200. If the cleaning fluid is subsequently wiped off again by the wiper 151, the individual conductor segments 305 of the cleaning sensor 200 are isolated from one another again. As a result of this, the electrical resistance increases between the measuring points 301, 302 of the cleaning sensor 200.

FIG. 3*c* shows examples of time curves 321, 322, 323 of the electrical resistance 320 of a cleaning sensor 200, in particular of the cleaning sensor 200 depicted in FIG. 3*a*, in a cleaning process. As of the first point in time 311, cleaning fluid is sprayed bit by bit along the cleaning axis 160 onto the surface 308 of the cleaning sensor 200, which has the result that the electrical resistance 320 decreases. Upon reaching the second point in time 312, the entire measurement surface 308 of the cleaning sensor 200, in particular the entire surface of the intervening spaces 306, is then covered with cleaning fluid so that the electrical resistance 320 is minimal. As of the third point in time 313, the cleaning fluid is then removed bit by bit from the surface 308 of the cleaning sensor 200 by the wiper 151 along the cleaning axis 160, until at a fourth point in time 314 cleaning fluid is no longer present, such that the electrical resistance 320 is maximal.

Given a cleaning process that is optimal and/or is not negatively affected, an additional reference curve 321 of the electrical resistance 320 of the cleaning sensor 200 thus results. During the operation of the cleaner 150, an actual curve 322, 323 of the electrical resistance 320 of the cleaning sensor 200 may be determined and, if applicable, be compared with the reference curve 321. Whether the cleaner 150 is negatively affected may be detected on the basis of the actual curve 322, 323. Furthermore, the cause or the type of the negative effect may possibly be detected. For example, an actual curve 322 in which the electrical resistance 320 no longer fully increases upon wipe-off may be an indication of a negatively affected wiper 151. On the other hand, an actual curve 323 in which the electrical resistance 320 does not decrease, or does not fully decrease, upon spraying on the cleaning fluid may be an indication of a negatively affected spray nozzle 155.

Given use of a cleaning sensor 200 having a parallel circuit of conductor segments 305, an insufficient decrease in the electrical resistance 320, for example, may be an indication that the entire width of a print head 103 that travels along the transport direction 1 is not sprayed with cleaning fluid. A subdivision of the cleaning sensor 200 into different partial segments along the transport direction 1 thereby also enables a localization of the unsprayed partial region. Conversely, an insufficiently increasing electrical resistance 320 indicates that the entire width of a print head 103 has not been wiped off.

A cleaning sensor 200 may thus be installed in the cleaner 150 and/or in the print bar 102. The cleaning sensor 200 may thereby be installed such that the cleaning sensor 200 is sprayed by the spray nozzle 155 of the cleaner 150 and is wiped off by the wiper 151 of the cleaner 150. In the first step, a check may thus be made as to whether and to what degree the surface 308 of the cleaning sensor 200 is wetted with cleaning fluid. The function of the one or more spray nozzles 155 may thus be checked. In a second step, a check may then be made as to whether the wiper 151 cleans off the cleaning fluid without residue. The setting and the function of the wiper 151 may thus be checked. The cleaning sensor 200 may be installed such that the cleaning sensor 200 is arranged at a level with the one or more print heads 103 so that the one or more spray nozzles 155 and/or the wiper 151 clean the one or more print heads 103 and the cleaning sensor 200, in particular along the cleaning axis 160.

The cleaning sensor 200 may comprise a chip or a circuit board with conductor traces 305, wherein the electrical circuit of the conductor traces 305 is not closed in the dry state. The conductor traces 305 may thereby be arranged in a serial circuit and/or in a parallel circuit. Given the serial circuit, after spraying it may thus be immediately detected whether the one or more spray nozzles 155 have sprayed across the entire width of the cleaning sensor 200, since only in this instance is the electrical circuit between the two measuring points 301, 302 closed. In the event that the one or more spray nozzles 155 do not reach a portion of the surface 308 of the cleaning sensor 200, the application of moisture thus does not take place uniformly, and the electrical circuit remains open.

In particular, the wipe-off quality of the wiper 151 may be checked with the parallel circuit depicted in FIG. 3*b*. In this instance, the higher the resistance of the measurement, the better that it can be determined whether the wiper 151 is situated flat and uniformly. If applicable, it may also be determined whether the wiper 151 is situated parallel to the nozzle plates of the one or more print heads 103 or not. This may in particular be achieved in that the conductor traces 305 that are connected with the second measuring point 302 are respectively sampled by a separate measuring point 301 with individual resolution.

FIG. 4 shows a workflow diagram of an example of a method 400, if applicable a computer-implemented method 4, for checking a cleaner 150 for cleaning the nozzle plates of one or more print heads 103 of a print bar 102. The print bar 102 may be part of an inkjet printer 100. The one or more print heads 103 may be arranged one after another along a cleaning axis 160.

The print bar 102 comprises a cleaning sensor 200 that exhibits an electrical resistance 320 that depends on whether cleaning fluid is located on the cleaning sensor 200 or not. The cleaning sensor 200 may, for example, comprise a circuit board having one or more conductor traces, or having one or more conductor segments 305. In particular, the cleaning sensor 200 may comprise at least two measuring points 301, 302 between which the electrical resistance 320 of the cleaning sensor 200 may be measured, for example by applying a measurement voltage at the measuring points 302, 302 and by measuring a measurement current at least at one of the measuring points 301, 302. The electrical resistance 320 may then be determined as a quotient of the measurement voltage and the measurement current.

The cleaning sensor 200 may have a measurement surface 398 that, for example, is adapted to the dimensions of the one or more print heads 103 of the print bar 102. In particular, the width of the measurement surface 308 may correspond to the width of a print head 103 along the transport direction 1 or transverse to the cleaning axis 160. The cleaning sensor 200 may be arranged before, after, or between the one or more print heads 103 of the print bar 102, along the cleaning axis 160. In particular, the cleaning sensor 200 may be arranged at the print bar 102 such that the measurement surface 308 of the cleaning sensor 200 is also cleaned within the scope of a cleaning process of the cleaner 150. A negative effect on the cleaner 150 may thus be reliably detected on the basis of the resistance data detected by the cleaning sensor 200, for example on the basis of the measurement current detected by the cleaning sensor 200.

Between two measuring points 301, 302, the cleaning sensor 200 may comprise a plurality of conductor segments 305 that are respectively spaced apart in pairs and electrically isolated from one another across an intervening space 306. An intervening space 306 between two conductor segments 305 and/or the cleaning fluid may thereby be designed such that the electrical resistance between the two conductor segments 305 is reduced if cleaning fluid is applied onto the intervening space 306. The cleaning sensor 200 may thus be designed to reliably detect whether cleaning fluid is located on the measurement surface 308 of the cleaning sensor 200 or not.

The conductor segments 305 of the cleaning sensor 200 may be arranged at least partially in respective pairs across intervening spaces 305, in series with one another, between the measuring points 301, 302. Alternatively or additionally, the conductor segments 305 may at least partially in respective pairs, across intervening spaces 306, in parallel. By providing a plurality of isolated conductor segments 305 that are distributed across the measurement surface 308, especially precise resistance data may be acquired in order to detect a negative effect on the cleaner 150 in a particularly precise and targeted manner. The dimension of the negative effect on the cleaner 150 may thereby be concluded on the basis of the value of the electrical resistance 320, in particular given a parallel circuit of the conductor segments 305.

The cleaning sensor 200 may thus be designed as a resistance sensor and/or as a circuit board sensor.

In particular when the cleaner 150 exhibits no negative effect, the cleaner 150 may be designed to apply cleaning fluid onto the nozzle plates of the one or more print heads 103 and onto the cleaning sensor 200 and to subsequently remove said cleaning fluid again, within the scope of a cleaning process.

For this purpose, the cleaner 150 may comprise at least one spray nozzle 155 that is configured to spray cleaning fluid onto the nozzle plates of the one or more print heads 103 and onto the cleaning sensor 200. The spray nozzle 155 may thereby possibly be at least partially clogged, which might lead to the situation that the nozzle plates of the one or more print heads 103 and/or the measurement surface 308 of the cleaning sensor 200 are covered with cleaning fluid only in one or more partial regions.

Alternatively or additionally, the cleaner 150 may comprise at least one wiper 151 that is configured to wipe cleaning fluid off of the nozzle plates of the one or more print heads 103 and off of the cleaning sensor 200. The wiper 151 may thereby possibly be incorrectly arranged so that the cleaning fluid is wiped off of the nozzle plates of the one or more print heads 103 and/or wiped off of the measurement surface of the cleaning sensor 200 only in one or more partial regions.

The cleaner 150 may have at least one sled 153 that is designed to direct the at least one spray nozzle 155 and/or the at least one wiper 151 along the cleaning axis 160, past the cleaning sensor 200 and the nozzle plates of the one or more print heads 103, within the scope of a cleaning process.

The method 400 includes ascertaining 401, within the scope of a cleaning process of the cleaner 150, resistance data with respect to the electrical resistance 320 of the cleaning sensor 200. In particular, resistance data may thereby be determined that indicate the time curve 322, 323 of the electrical resistance 320 of the cleaning sensor 200 during the cleaning process. Given a cleaner 150 that is not negatively affected, the time curve 322, 323 may thereby be a reference curve 321. In the reference curve 321, the electrical resistance 320 may initially decrease when cleaning fluid is applied onto the measurement surface 308. At a later point in time, the electrical resistance 320 may increase again when the cleaning fluid is removed from the measurement surface 308.

The method 400 also includes determining 402, on the basis of the resistance data, whether the cleaner 150 exhibits a negative effect or not. In particular, on the basis of the time curve 322, 3233 of the electrical resistance 320 it may be determined whether a negative effect on the cleaner 150 is present or not, especially with respect to the application of the cleaning fluid and/or with respect to the removal of the cleaning fluid. For example, whether the spray nozzle 155 and/or the wiper 151 exhibit a negative effect or not may be determined on the basis of the resistance data, in particular on the basis of the time curve 322, 323 of the electrical resistance 320.

A negative effect on a cleaner 150 of an inkjet printer 100 may be precisely and reliably detected via the consideration of resistance data that are detected during a cleaning process of a cleaning sensor 200.

Within the scope of the method 400, the time curve 322, 323 of the electrical resistance 320 of the cleaning sensor 200 during the cleaning process may be compared with the reference curve 321 of the electrical resistance 320 of the cleaning sensor 200 that should be present for a cleaner 150 that is not negatively affected. The negative effect on the cleaner 150, in particular on the spray nozzle 155 and/or the wiper 151, may then be especially precisely detected on the basis of the comparison. The type of negative effect, for example a faulty spray nozzle 155 and/or a faulty wiper 151, may also be ascertained, if applicable, on the basis of the comparison.

As has already been presented above, the cleaner 150 may also be configured to direct the spray nozzle 155 and the wiper 151 bit by bit along the cleaning axis 160, for example on a common sled 153, past the nozzle plates of the one or more print heads 103 and past the cleaning sensor 200. The cleaning sensor 200 may be designed to acquire resistance data for different partial regions that are arranged side by side along a segment axis that travels orthogonal to the cleaning axis 160. The segment axis may thereby correspond to the transport direction 1. For this purpose, the cleaning sensor 200 may have different pairs of measuring points 301, 302 that cover different partial regions of the measurement surface 308 and that may respectively detect the electrical resistance 320 in the respective partial region.

Within the scope of the method 400, on the basis of the resistance data it may then be detected, if applicable, that a defined partial region of the nozzle plates of the one or more print heads 103 has not been correctly sprayed with cleaning fluid or has not been correctly wiped off within the scope of the cleaning process, and thus the cleaner 150, in particular the spray nozzle 155 and/or the wiper 151, exhibits a negative effect. A negative effect on the cleaner 150 may be detected with increased precision via the use of a cleaning sensor 200 having different partial segments for different partial regions of the nozzle plates of the one or more print heads 103.

Within the scope of the method 400, whether the measurement surface 308 of the cleaning sensor 200, in particular of the resistance sensor, has been completely sprayed or not may be checked within the scope of the method 400, in particular on the basis of the resistance data. This may be determined on the basis of a first part of the time curve 322, 323 of the electrical resistance 320. A negative effect on the spray nozzle 155, for example a clog, may thus be detected.

Furthermore, within the scope of the method 400, whether the measurement surface 308 of the cleaning sensor 200 has been completely wiped off may be checked on the basis of the resistance data, in particular on the basis of a subsequent second part of the time curve 322, 323 of the electrical resistance 320. A negative effect on the wiper 151, for example a faulty positioning, may thus be detected.

Furthermore, in this document a corresponding controller 101 is described for checking a cleaner 150 for cleaning the nozzle plates of one or more print heads 103 of a print bar 102, wherein the print bar 102 comprises a cleaning sensor 200 that exhibits an electrical resistance 320 that depends on whether cleaning fluid is located on the cleaning sensor 200 or not.

The controller 101 may be configured to ascertain, within the scope of a cleaning process of the cleaner 150, resistance data with respect to the electrical resistance 320 of the cleaning sensor 200. Furthermore, the controller 101 may be configured to detect, on the basis of the resistance data, a negative effect on the cleaner 150.

A controller 101 is thus described that is designed to check, via evaluation of the resistance data of a cleaning sensor 200 arranged on a print bar 102 of an inkjet printer 100, whether a cleaner 150 for cleaning of the one or more print heads 103 of the print bar 102 exhibits a negative effect. The state of a cleaner 150 may be reliably and efficiently monitored via the installation of a cleaning sensor 200 in a print bar 102.

Furthermore, in this document a printer 100 is described for printing to a recording medium 120. The printer 100 comprises at least one print bar 102 having one or more print heads 103 that are designed to print a print image on a recording medium 120. The one or more print heads 103 may be arranged in one or more different rows at the print bar 102, wherein the one or more rows may respectively run parallel to the cleaning axis 160.

The print bar 102 also comprises at least one cleaning sensor 200 that exhibits an electrical resistance 320 that depends on whether cleaning fluid is located on the cleaning sensor 200 or not. In other words, the cleaning sensor 200 may be designed to detect whether cleaning fluid is located on the measurement surface 308 of the cleaning sensor 200 or not. The cleaning sensor 200 may be arranged before or after the one or more print heads 103 of the print bar 102 along the cleaning axis 160 of the cleaner 150. The print bar 102 may have at least one cleaning sensor 200 per print head row.

The printer 100 also comprises at least one cleaner 150 that is designed to apply cleaning fluid onto the nozzle plates of the one or more print heads 103 and onto the measurement surface 308 of the cleaning sensor 200, and to subsequently remove said cleaning fluid from them again, within the scope of a cleaning process.

Furthermore, the printer 100 comprises the controller 101 described in this document. The controller 101 may be configured to detect a negative effect on the cleaner 150 on the basis of resistance data with respect to the electrical resistance 320 of the cleaning sensor 200, within the scope of a cleaning process of the cleaner 150.

Furthermore, in this document a cleaner 150 and/or a print bar 102 are described that comprise the control controller 101 described in this document.

An efficient and reliable monitoring of a wiper 151 and/or of a spray nozzle 155 of a cleaner 150 is enabled via the measures described in the present disclosure. The reliability and the print quality of a printer 100 may thus be increased.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein. In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)
21, 22 nozzle
31, 32 column (of the print bar)
100 printing device (printer)
101 controller
102 print bar
103 print head
120 recording medium
140 print group
150 cleaning unit (cleaner)
151 wiper
152 cleaning module
153 sled/wiper holder
154 guide rail
155 spray nozzle
160 cleaning axis
200 cleaning sensor
301, 302 measuring points
305 conductor segment
306 intervening space
308 measurement surface
311-314 points in time
320 electrical resistance
321 reference curve of the electrical resistance
322, 323 measured or actual curve of the electrical resistance
400 method for checking a cleaner
401, 402 method steps

The invention claimed is:

1. A controller for checking a cleaner for cleaning the nozzle plates of one or more print heads of a print bar having a cleaning sensor configured to exhibit an electrical resistance based on a presence of cleaning fluid on the cleaning sensor, the cleaner being configured to apply cleaning fluid onto the nozzle plates of the one or more print heads and onto the cleaning sensor, and to subsequently remove the applied cleaning fluid, within a cleaning process, the controller comprising:

an interface that is configured to receive resistance data from the cleaning sensor with respect to the electrical resistance of the cleaning sensor, wherein the cleaner is configured move along a cleaning axis past the nozzle plates of the one or more print heads and past the cleaning sensor, the resistance data corresponding to different partial segments of the cleaning sensor arranged side by side along a segment axis orthogonal to the cleaning axis; and processing circuitry that is configured to detect a negative effect on the cleaner based on the resistance data to identify an improper cleaning for one or more different partial regions of the nozzle plates respectively corresponding to the different partial segments.

2. The controller according to claim 1, wherein the processing circuitry is configured to:

determine a time curve of the electrical resistance of the cleaning sensor during the cleaning process based on the resistance data; and detect, based on the time curve of the electrical resistance, the negative effect on the cleaner with respect to the application of the cleaning fluid and/or with respect to the removal of the cleaning fluid.

3. The controller according to claim 2, wherein the processing circuitry is configured to:

compare the time curve of the electrical resistance of the cleaning sensor during the cleaning process with a reference curve of the electrical resistance of the cleaning sensor; and detect the negative effect on the cleaner based on the comparison.

4. The controller according to claim 1, wherein:

the cleaner comprises:

a spray nozzle that is configured to spray cleaning fluid onto the nozzle plates of the one or more print heads and onto the cleaning sensor; and a wiper that is configured to wipe cleaning fluid off of the nozzle plates of the one or more print heads and off of the cleaning sensor; and the processing circuitry is configured to detect, based on the resistance data, a negative effect on the spray nozzle and/or the wiper.

5. The controller according to claim 4, wherein the cleaner is configured to direct the spray nozzle and the wiper bit-by-bit along the cleaning axis, past the nozzle plates of the one or more print heads and past the cleaning sensor;

the cleaning sensor is configured to acquire the resistance data for the different partial regions; and processing circuitry is configured to detect, based on the resistance data, that the one or more partial regions of the nozzle plates of the one or more print heads has been incorrectly sprayed or has been incorrectly wiped off within the scope of the cleaning process.

6. The controller according to claim 5, wherein the processing circuitry is configured to determine that the spray nozzle or the wiper exhibits a negative effect based on the detection that the one or more partial regions of the nozzle plates of the one or more print heads has been incorrectly sprayed or has been incorrectly wiped off, respectively.

7. The controller according to claim 1, wherein:

the cleaning sensor comprises a plurality of conductor segments between two measuring points, the conductor segments being respectively spaced apart and electrically isolated from one another in pairs across an intervening space; and the cleaning sensor is configured such that an electrical resistance between two of the plurality of conductor segments is reduced in response to cleaning fluid being applied onto the intervening space.

8. The controller according to claim 7, wherein the plurality of conductor segments are respectively arranged in series with respect to one another between the measuring points, across intervening spaces.

9. The controller according to claim 7, wherein the plurality conductor segments are respectively arranged in parallel in pairs across intervening spaces.

10. The controller according to claim 7, wherein a first subset of the plurality of conductor segments are respectively arranged in series with respect to one another between the measuring points, across intervening spaces, and a second subset of the plurality conductor segments are respectively arranged in parallel in pairs across intervening spaces.

11. A printer for printing to a recording medium, the printer comprising:

a print bar having one or more print heads that are configured to print a print image onto a recording medium, the print bar including a cleaning sensor configured to exhibit an electrical resistance based on a presence of cleaning fluid on the cleaning sensor;

a cleaner that is configured to move along a cleaning axis past nozzle plates of the one or more print heads and past the cleaning sensor and to apply cleaning fluid onto the nozzle plates of the one or more print heads and onto the cleaning sensor, and to subsequently remove the cleaning fluid; and a controller that is configured to detect a negative effect on the cleaner based on resistance data with respect to the electrical resistance of the cleaning sensor to identify an improper cleaning for one or more different partial regions of the nozzle plates respectively corresponding to different partial segments of the cleaning sensor arranged side by side along a segment axis orthogonal to the cleaning axis, wherein the resistance data corresponds to the different partial segments of the cleaning sensor.

12. The printer according to claim 11, wherein the cleaning sensor is arranged before or after the one or more print heads of the print bar, along the cleaning axis of the cleaner.

13. The printer according to claim 12, wherein the cleaning axis is orthogonal to a transport direction of the recording medium.

14. A method for checking a cleaner for cleaning the nozzle plates of one or more print heads of a print bar having a cleaning sensor that is configured to exhibit an electrical resistance based on a presence of cleaning fluid on the cleaning sensor, the cleaner being configured to apply the cleaning fluid onto the nozzle plates of the one or more print heads and onto the cleaning sensor, and to subsequently remove the cleaning fluid, the method comprising:

ascertaining resistance data with respect to the electrical resistance of the cleaning sensor, wherein the cleaner is configured move along a cleaning axis past the nozzle plates of the one or more print heads and past the cleaning sensor, the resistance data corresponding to different partial segments of the cleaning sensor arranged side by side along a segment axis orthogonal to the cleaning axis; and determining, based on the resistance data, whether the cleaner exhibits a negative effect to identify an improper cleaning for one or more different partial regions of the nozzle plates respectively corresponding to the different partial segments.

15. A non-transitory computer-readable storage medium with an executable program stored thereon, that when executed, instructs a processor to perform the method of claim 14.

* * * * *